US008590349B2

(12) United States Patent
Skjellerup et al.

(10) Patent No.: US 8,590,349 B2
(45) Date of Patent: Nov. 26, 2013

(54) SECURITY TAG ASSEMBLY

(75) Inventors: Johan Skjellerup, Boca Raton, FL (US); Eddie L. Stenilo, Dragor (DK)

(73) Assignees: Braebum Asset Holdings, LLC. (BS); ES Holding Dragoer APS (DK)

( * ) Notice: Subject to any disclaimer, the term of this patent is extended or adjusted under 35 U.S.C. 154(b) by 0 days.

(21) Appl. No.: 13/425,055

(22) Filed: Mar. 20, 2012

(65) Prior Publication Data

US 2013/0247623 A1 Sep. 26, 2013

(51) Int. Cl.
*E05B 65/00* (2006.01)

(52) U.S. Cl.
USPC ..... 70/57.1; 70/276; 70/386; 24/704.1; 24/704.2; 24/706.8; 340/572.9

(58) Field of Classification Search
USPC ..... 70/57.1, 276, 386; 24/704.1, 704.2, 24/706.8; 292/307 A; 340/572.8, 572.9, 340/572.1
See application file for complete search history.

(56) References Cited

U.S. PATENT DOCUMENTS

| | | | | |
|---|---|---|---|---|
| D205,049 | S | 6/1966 | Brady | |
| 3,974,581 | A | 8/1976 | Martens et al. | |
| 4,104,622 | A * | 8/1978 | Van Niel | 340/572.8 |
| 4,299,870 | A | 11/1981 | Humble | |
| 4,339,853 | A | 7/1982 | Lipschitz | |
| 4,510,489 | A | 4/1985 | Anderson, III et al. | |
| 4,523,356 | A | 6/1985 | Charlot, Jr. | |
| 4,527,310 | A | 7/1985 | Vandebult | |
| 4,590,461 | A | 5/1986 | Cooper | |
| 4,603,453 | A | 8/1986 | Yokoyama | |
| 4,651,136 | A | 3/1987 | Anderson et al. | |
| 4,670,950 | A | 6/1987 | Wisecup et al. | |
| 4,685,234 | A | 8/1987 | Anderson et al. | |
| 4,774,503 | A | 9/1988 | Bussard | |
| 4,884,833 | A | 12/1989 | Pedersen | |
| 4,944,075 | A | 7/1990 | Hogan | |
| 4,993,245 | A | 2/1991 | Ott | |
| 5,031,287 | A | 7/1991 | Charlot, Jr. et al. | |
| 5,054,172 | A | 10/1991 | Hogan et al. | |
| 5,077,872 | A | 1/1992 | Guthammar | |
| 5,088,165 | A | 2/1992 | Minasy et al. | |
| 5,151,684 | A | 9/1992 | Johnsen | |
| 5,205,024 | A | 4/1993 | Willard | |
| 5,208,580 | A | 5/1993 | Crossfield | |

(Continued)

FOREIGN PATENT DOCUMENTS

| | | | |
|---|---|---|---|
| BE | 1004849 | A7 | 2/1993 |
| DE | 20014860 | U1 | 10/2000 |

(Continued)

*Primary Examiner* — Lloyd Gall
(74) *Attorney, Agent, or Firm* — Malloy & Malloy, P.L.

(57) ABSTRACT

A security tag assembly structured to restrict unauthorized removal of merchandise from a designated area is presented. The security tag assembly comprises a base and a tag member removably connected to the merchandise being protected or monitored. A locking assembly is disposed within the base and is structured to be biased into a locking orientation relative to a connector pin of the tag member. A release assembly, also disposed within the base, is structured to facilitate the authorized release of the locking assembly upon application of an externally applied detachment assembly. In particular the release assembly comprises a displacement structure including coaxially disposed first and second members connected via an at least partially flexible biasing connector comprising an arcuate or "U" shaped configuration. The second collar is structured for disposition into a displacing engagement with the locking assembly upon the forced movement of the first collar.

20 Claims, 16 Drawing Sheets

(56) References Cited

U.S. PATENT DOCUMENTS

| | | | | |
|---|---|---|---|---|
| D343,134 | S | 1/1994 | Witzky | |
| D343,135 | S | 1/1994 | Witzky | |
| D344,033 | S | 2/1994 | Davidge | |
| 5,347,262 | A | 9/1994 | Thurmond et al. | |
| 5,367,289 | A | 11/1994 | Baro et al. | |
| D354,924 | S | 1/1995 | Garner et al. | |
| 5,426,419 | A | 6/1995 | Nguyen et al. | |
| 5,497,639 | A | 3/1996 | Charlot, Jr. | |
| 5,587,703 | A | 12/1996 | Dumont | |
| 5,600,977 | A | 2/1997 | Piron | |
| 5,613,384 | A | 3/1997 | Weber et al. | |
| 5,748,089 | A | 5/1998 | Sizemore | |
| 5,786,762 | A | 7/1998 | Liu | |
| D410,400 | S | 6/1999 | Skjellerup | |
| 5,912,622 | A | 6/1999 | Endo et al. | |
| 5,942,978 | A | 8/1999 | Shafer | |
| 5,942,987 | A | 8/1999 | Heinrich et al. | |
| 5,955,951 | A | 9/1999 | Wischerop et al. | |
| 6,023,951 | A | 2/2000 | Maurer et al. | |
| 6,089,453 | A | 7/2000 | Kayser et al. | |
| 6,281,800 | B1 | 8/2001 | Sizemore | |
| 6,348,865 | B1 | 2/2002 | Siegel | |
| D455,363 | S | 4/2002 | Fuss | |
| 6,535,130 | B2 | 3/2003 | Nguyen et al. | |
| 6,722,166 | B2 | 4/2004 | Skjellerup | |
| 6,724,307 | B1 | 4/2004 | Siegel | |
| 6,752,837 | B2 | 6/2004 | Karp | |
| D494,488 | S | 8/2004 | Sayegh | |
| 6,774,794 | B2 | 8/2004 | Zimmerman et al. | |
| 7,073,236 | B2 | 7/2006 | Xue et al. | |
| 7,075,440 | B2 | 7/2006 | Fabian et al. | |
| 7,148,805 | B2 | 12/2006 | Hogan | |
| 7,183,917 | B2 | 2/2007 | Piccoli et al. | |
| 7,190,272 | B2 | 3/2007 | Yang et al. | |
| 7,286,054 | B2 | 10/2007 | Skjellerup et al. | |
| 7,347,068 | B2 | 3/2008 | Seidel | |
| 7,382,256 | B2 | 6/2008 | Skjellerup et al. | |
| 7,400,254 | B2 | 7/2008 | Yang et al. | |
| 7,474,216 | B2 | 1/2009 | Skjellerup et al. | |
| 7,474,222 | B2 * | 1/2009 | Yang et al. | 340/572.8 |
| 7,523,630 | B2 | 4/2009 | Skjellerup | |
| D603,739 | S | 11/2009 | Skjellerup | |
| 7,652,574 | B2 | 1/2010 | Sayegh | |
| 7,750,806 | B1 | 7/2010 | Skjellerup et al. | |
| 7,817,041 | B2 | 10/2010 | Skjellerup et al. | |
| 8,051,686 | B2 * | 11/2011 | Garner | 70/57.1 |
| 8,223,022 | B2 | 7/2012 | Skjellerup et al. | |
| 8,242,910 | B2 | 8/2012 | Skjellerup et al. | |
| 2002/0105424 | A1 | 8/2002 | Alicot et al. | |
| 2003/0067397 | A1 | 4/2003 | Trimble | |
| 2004/0070507 | A1 | 4/2004 | Campero | |
| 2004/0231375 | A1 | 11/2004 | Skjellerup | |
| 2004/0233042 | A1 | 11/2004 | Piccoli et al. | |
| 2005/0030182 | A1 * | 2/2005 | Hogan | 340/572.9 |
| 2005/0218218 | A1 | 10/2005 | Koster | |
| 2006/0139176 | A1 | 6/2006 | Skjellerup et al. | |

FOREIGN PATENT DOCUMENTS

| | | | |
|---|---|---|---|
| DE | 202004008789 | U1 | 11/2004 |
| DE | 202004013895 | U1 | 12/2004 |
| EP | 0012923 | A1 | 7/1980 |
| EP | 142748 | | 5/1985 |
| EP | 0404329 | A1 | 12/1990 |
| EP | 0594324 | A4 | 4/1994 |
| EP | 1391574 | | 2/2004 |
| JP | 2005-71143 | | 3/2005 |
| JP | 2006-249364 | | 9/2006 |
| WO | WO2004/106674 | A1 | 12/2004 |
| WO | WO2005/118991 | A1 | 12/2005 |

* cited by examiner

SECURITY TAG ASSEMBLY

BACKGROUND OF THE INVENTION

1. Field of the Invention

The present invention relates to a security tag assembly or system comprising a base and an attachment member removably securable to various types of merchandise. In particular, the security tag assembly comprises a locking assembly structured to restrict unauthorized removal of the tag assembly from the merchandise and a release assembly cooperatively structured to release the locking assembly upon application of or contact with a detachment assembly.

2. Description of the Related Art

Security or anti-theft tags are extensively used in the retail merchandising industry as well as numerous other areas of commerce. In typical fashion, such devices are attached to various types of merchandise in such a manner that that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

As set forth above, known security or anti-theft tags are intended to provide some indication which either renders the merchandise useless or alternatively signals an attempted unauthorized removal.

While popular, it is recognized that a significant number of the anti-theft tags currently being utilized include problems or disadvantages which render them less than totally efficient. More specifically, wide spread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for a security system incorporating an anti-theft device preferably in the form of a relatively small security tag assembly which efficiently connects to various types of merchandise and which is specifically structured to overcome known techniques to remove or otherwise defeat such devices. Moreover, such protective structural features should be compatible with an efficient tag construction and configuration. Therefore, a security tag manufacture or provider to can effectively "customize" a proposed indicator assembly to include various "theft indicating" devices, electronic signaling devices or a combination thereof, while not requiring a restructuring or redesign of the entire tag assembly or the remaining, basic operable components associated therewith.

SUMMARY OF THE INVENTION

The present invention is generally directed to a security tag assembly which is structured to restrict the unauthorized removal of a product or merchandise item from a store or other designated area. In particular, the security tag assembly of the various embodiments disclosed herein includes a base and a tag or attachment member. The base comprises a locking assembly which is disposed therein, preferably in an inaccessible location, and is structured to be normally biased into a locking orientation. The tag or attachment member comprises an elongated connector pin structured and disposed to pass through the merchandise (e.g., clothing or other garments) and into a locking position with the locking assembly disposed within the base.

In addition, the tag assembly of the invention disclosed herein further includes a release assembly disposed within the base and structured for movable disposition upon application of an external detachment assembly. Specifically, the release assembly of a preferred embodiment comprises a displacement structure 60 which is structured and disposed to flex or move upon application of the detachment assembly. For instance, in one embodiment, the displacement structure comprises first and second collars or members disposed in an axial alignment with one another and connected via at least one flexible, deformable or resilient biasing connector.

The first collar is engaged, either directly or indirectly (via a contact collar) by the detachment assembly and forced to move in a first direction, e.g., in the same direction as the detachment assembly. The biasing connector(s) of one embodiment comprise an arcuate or "U" shaped configuration and connect the first collar to the second collar. Upon movement of the first collar in the first direction, the flexible, arcuate biasing member is structured to cause the second collar to move in a substantially opposite direction as the movement of the first collar. Because the second collar is structured to engage a portion of the locking assembly (either directly via corresponding lips or edges, or indirectly via intermediate structures), movement of the second collar is structured to dispose the locking assembly in a displaced engagement relative to the connector pin or otherwise release the locking assembly from a locked engagement with the connector pin so as to allow the base and tag members to be removed from one another.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
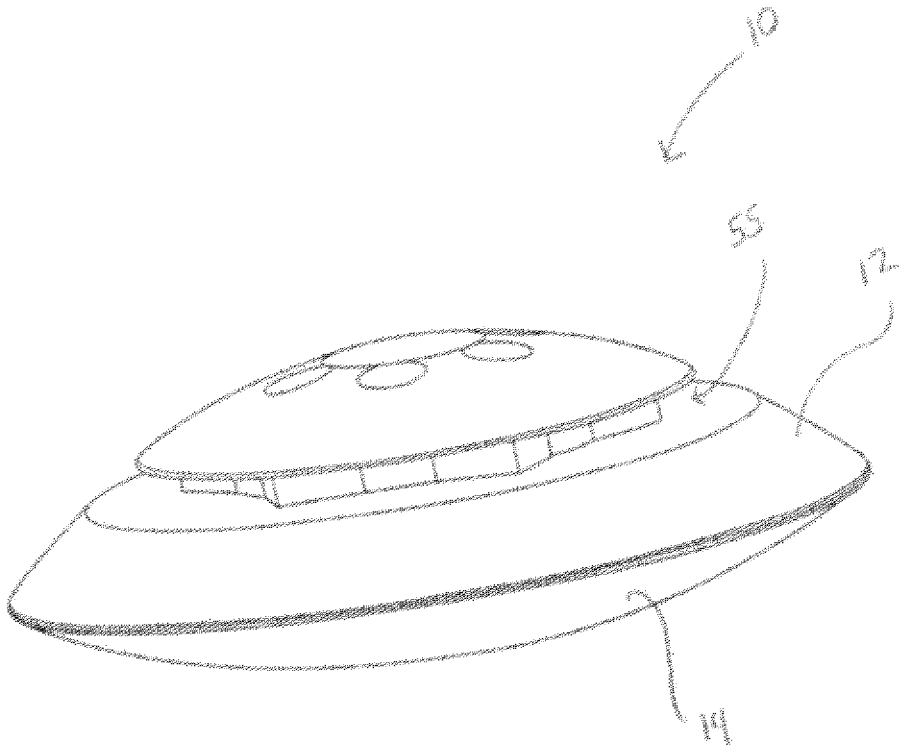
FIG. 1 is a perspective view of one preferred embodiment of the security tag assembly as disclosed in accordance with the present invention.
Figure 2:
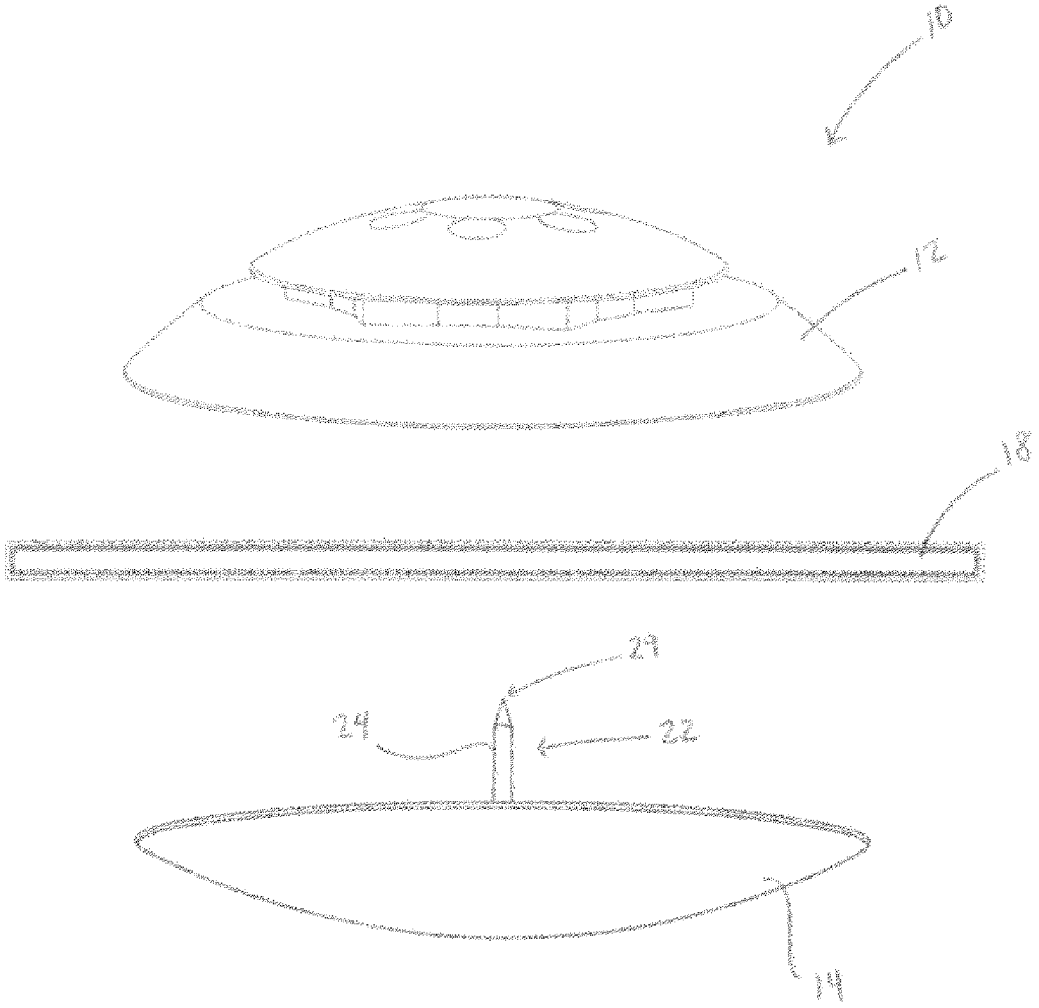
FIG. 2 is a partially exploded view of the security tag assembly illustrated in FIG. 1 showing the base and attachment member in an unassembled orientation.

As shown in the accompanying drawings, the present invention is directed towards a security tag assembly, generally indicated as 10, comprising at least one base 12 and at least one attachment or tag member 14. However, a practical application of the present invention would typically involve a plurality of bases 12 and a plurality of attachment or tag members 14, such as when a plurality of different products are being protected and/or monitored. Moreover, the security tag assembly 10 is of the type structured to be removably secured to various types of merchandise 18 so as to prevent unauthorized removal of the merchandise 18 from a given area or location. Typical applications for the security tag assembly 10 of the present invention include the interconnecting of one base 12 and any one of a plurality of attachment or tag members 14 to merchandise 18 being protected. As such, removal of the security tag assembly 10 from its operative position can be quickly and easily accomplished by authorized personnel using approved techniques or hardware. To the contrary, separation of the base 12 and the attachment member 14 from the operative position and the protected merchandise is extremely difficult when attempted by unauthorized personnel.

Figure 3A:
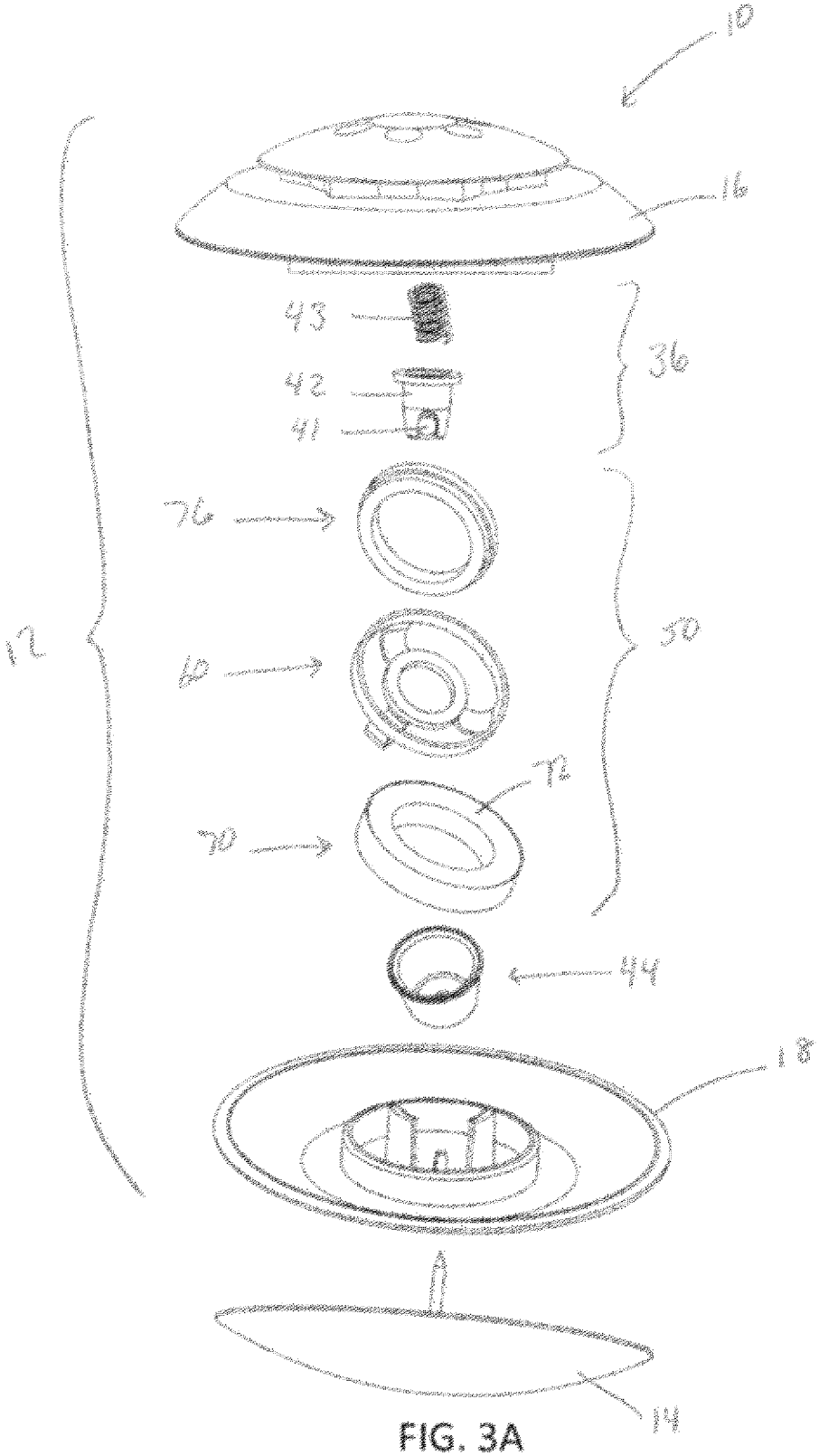
FIG. 3A is an exploded view of at least one embodiment of the present invention.
Figure 3B:
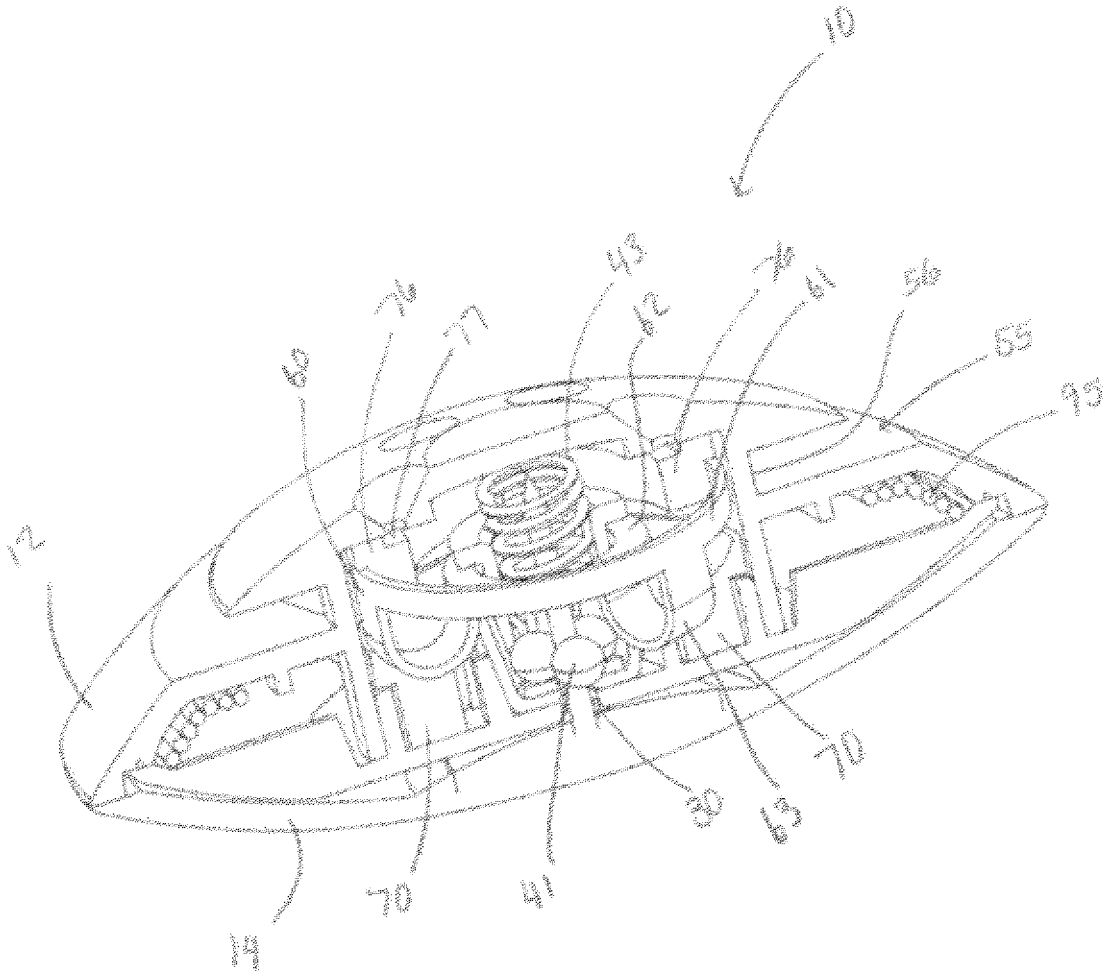
FIG. 3B is an interior sectional view in perspective of the security tag assembly.
Figure 3C:
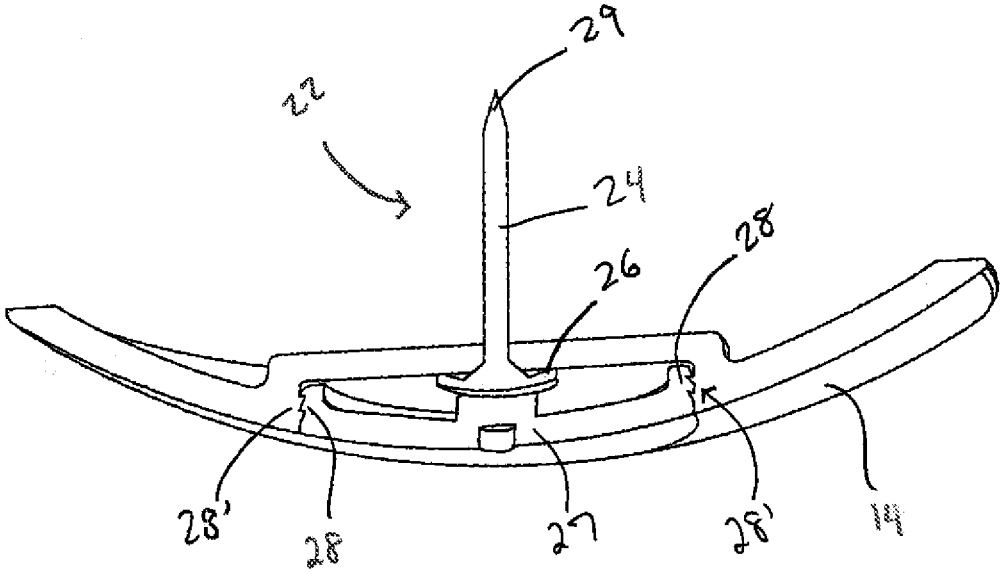
FIG. 3C is a partial cut-away view of the attachment member of at least one embodiment of the present invention.

In order to maintain a secure interconnection between the base 12 and the one or more attachment members 14, the attachment member(s) 14 is provided with a connector member, generally indicated as 22, which, in at least one embodiment, comprises an elongated connector pin or like structure 24. The length of the connector member 22 is sufficient to extend outwardly from the attachment member 14 so as to engage and be properly connected to the base 12. FIG. 3C illustrates a cut-away view of the attachment member 14 of at least one embodiment of the present invention. For instance, in one embodiment, connector member 22 comprises a head 26 securely, but rotatably engaged within the attachment member 14. For example, the present invention may comprise engagement member 27 with engaging teeth or other connection devices 28 structured for tight engagement with cooperatively disposed teeth or connection devices 28' disposed on the attachment member 14. In this manner, the connector member 24 may be securely sandwiched or disposed within the attachment member 14 by virtue of the snug attachment of the engagement member 27 relative to the head portion 26. This configuration allows the connector member 22 or pin to rotate independently of the attachment member 14 or base 12, thereby increasing security and further preventing the unauthorized removal thereof.

Moreover, cooperative structuring of each of the plurality of bases 12 includes a passage or channel comprising a proximal end or opening 30 (at least partially illustrated in FIG. 3B) configured for receipt of the connector member 22 therein and into an engaging relation with the base 12. The securing of the attachment member 14 in the preferred, operative position comprises penetration of the merchandise 18 by the connector pin 24 and continued travel of the connector pin 24 through the open proximal end 30 and into the interior of the base 12. Penetration of the merchandise 18 by the connector pin 24 as well as its passage into the base 12 may further be facilitated by a pointed or other appropriately shaped tip 29, as demonstrated.

Additional structural features of the present invention include the provision of a locking assembly, generally indicated as 36. The locking assembly 36 is disposed on or preferably within the interior of the base 12, such as between end caps 16 and 18 of base 12, and/or at least in communication with opening 30 so as to be disposed in receiving relation to the connector member 22. Therefore, as the connector pin 24 is disposed into its connected, operative orientation relative to the base 12, it will pass through open end 30 (best illustrated in FIG. 3B) and be received by the locking assembly 36 as the connector member 22 is passed there through.

Figure 4A:
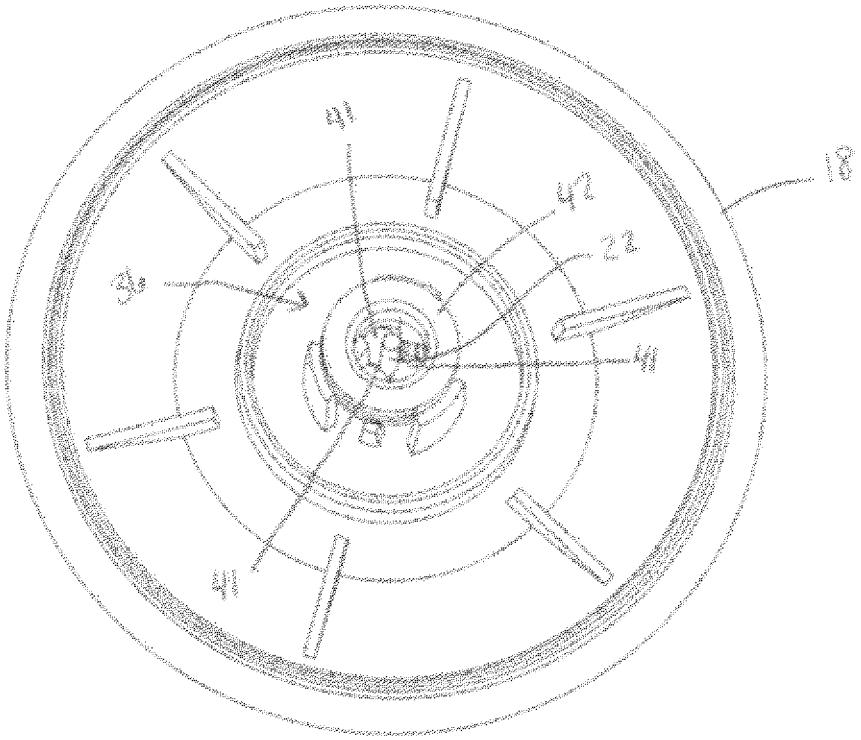
FIG. 4A is a partial perspective view of the retention casing and locking members of a locking assembly as disclosed in accordance with at least one embodiment of the present invention.
Figure 4B:
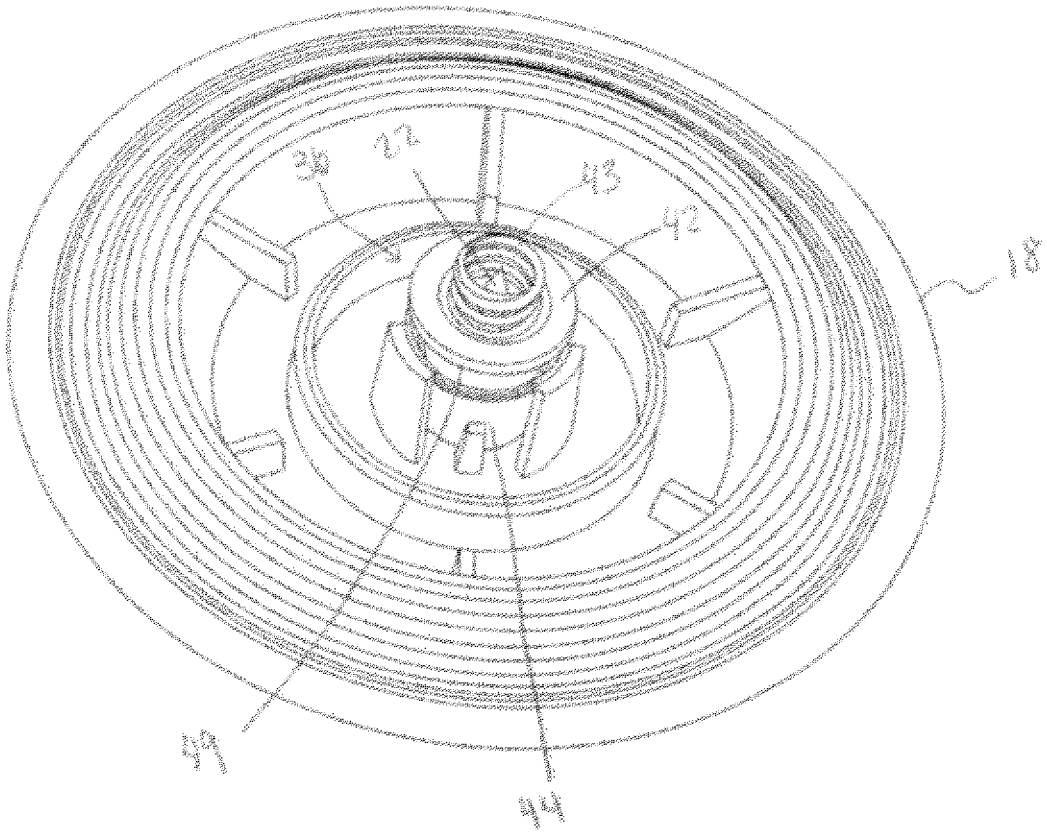
FIG. 4B is a partial perspective view of the embodiment shown in FIG. 4A, with the biasing member illustrated.

In particular, the locking assembly 36 of the various embodiments of the present invention may include, for example, a plurality of locking members, such as ball-type locking members 41, disposed at least partially on the interior of a retention casing 42. In addition, a biasing member 43 serves to bias the locking members 41 and/or the retention casing 42 in a confronting, locking engagement with the exterior of the connector member 22 and thereby assume a locking orientation of the locking assembly 36. In particular, as shown in FIGS. 4A and 4B (which, for illustrative purposes only shows the locking assembly 36 without the interconnected release assembly 50), the retention casing 42 is disposed in a partially surrounding and/or engaging relation with the biasing member 43 and in a retaining relation to the locking members 41. In addition, at least one embodiment further comprises a retention structure or seat 44 disposed in an at least partially surrounding and/or receiving relation to the retention casing 42 and/or locking members 41. As a result of the force exerted on the locking members 41 and/or retention casing 42 by the biasing member 43, the plurality of locking members 41 will be forced into the locking orientation and locking engagement with the exterior surface of the connector member 22. Accordingly, the locking assembly 36 can therefore be said to be normally biased into the locking orientation as represented herein. It should be noted that other locking assemblies not illustrated may be implemented in accordance with the present invention including, for example, a plurality of spaced apart retention fingers, one or more frictional rings, etc.

Referring again to FIG. 3A, additional structural features of the present invention include a release assembly 50 preferably disposed within the base 12, and in particular, at least partially between end caps 16 and 18 thereof. More in particular, the release assembly 50 is disposed in an at least partially engaging relation with at least a portion of the locking assembly 36, such as, but certainly not limited to, the retention casing 42 described above. For instance, in at least one embodiment, the release assembly 50 comprises an edge or lip 48 (illustrated in the partial cut-away view of FIG. 5) which is engaged or confronted by a cooperatively structured lip or edge 49 of the retention casing 42. In particular, the inter-engagement of lips or edges 48 and 49 are structured and configured to allow the release assembly 50 to dispose the locking assembly 36 in a displaced engagement sufficient to dispose the locking assembly 36 out of the locked orientation relative to the connector member 22.

Figure 4C:
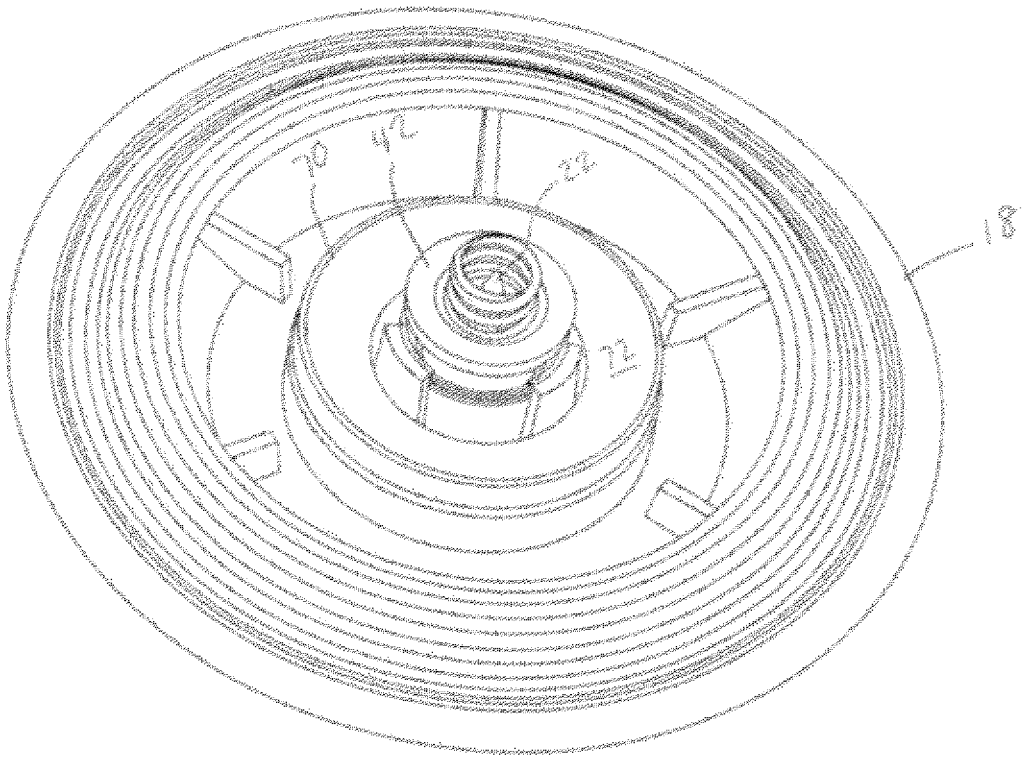
FIG. 4C is a partial perspective view of the embodiment shown in FIG. 4B, with the support member illustrated.
Figure 4D:
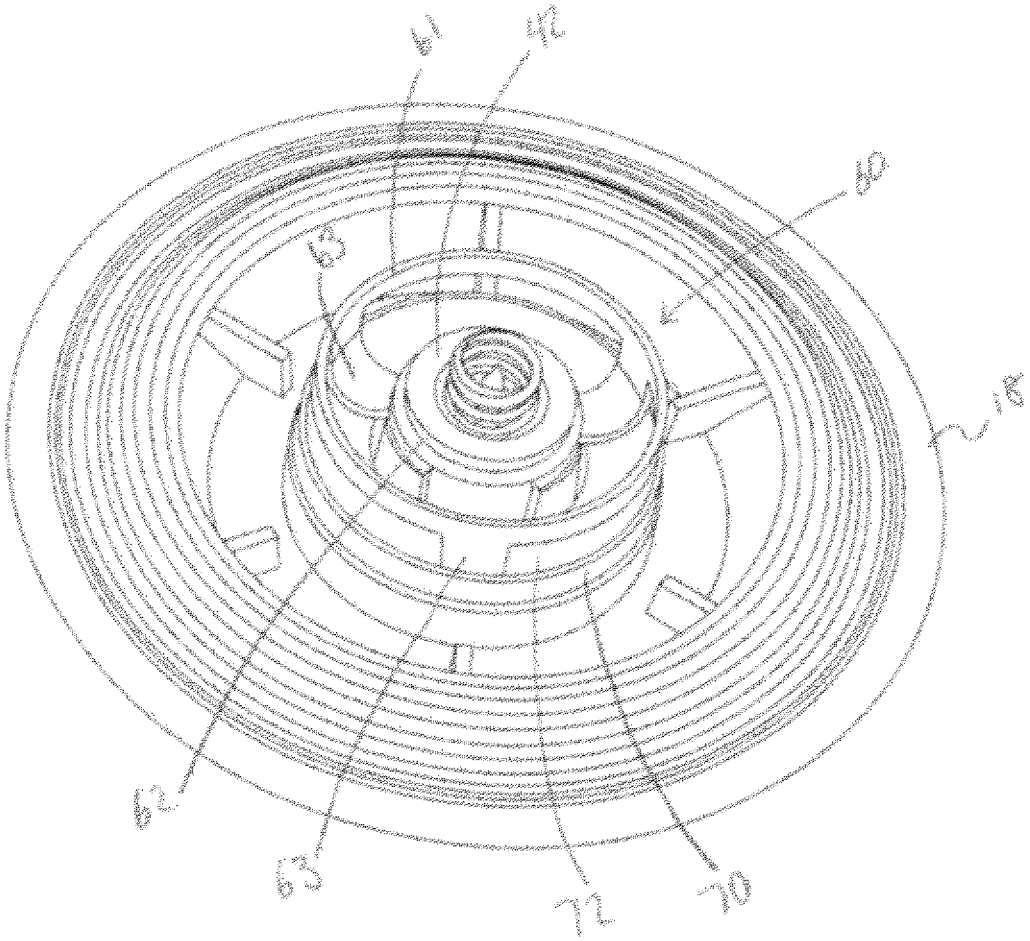
FIG. 4D is a partial perspective view of the embodiment shown in FIG. 4C, with the displacement structure illustrated.
Figure 4E:
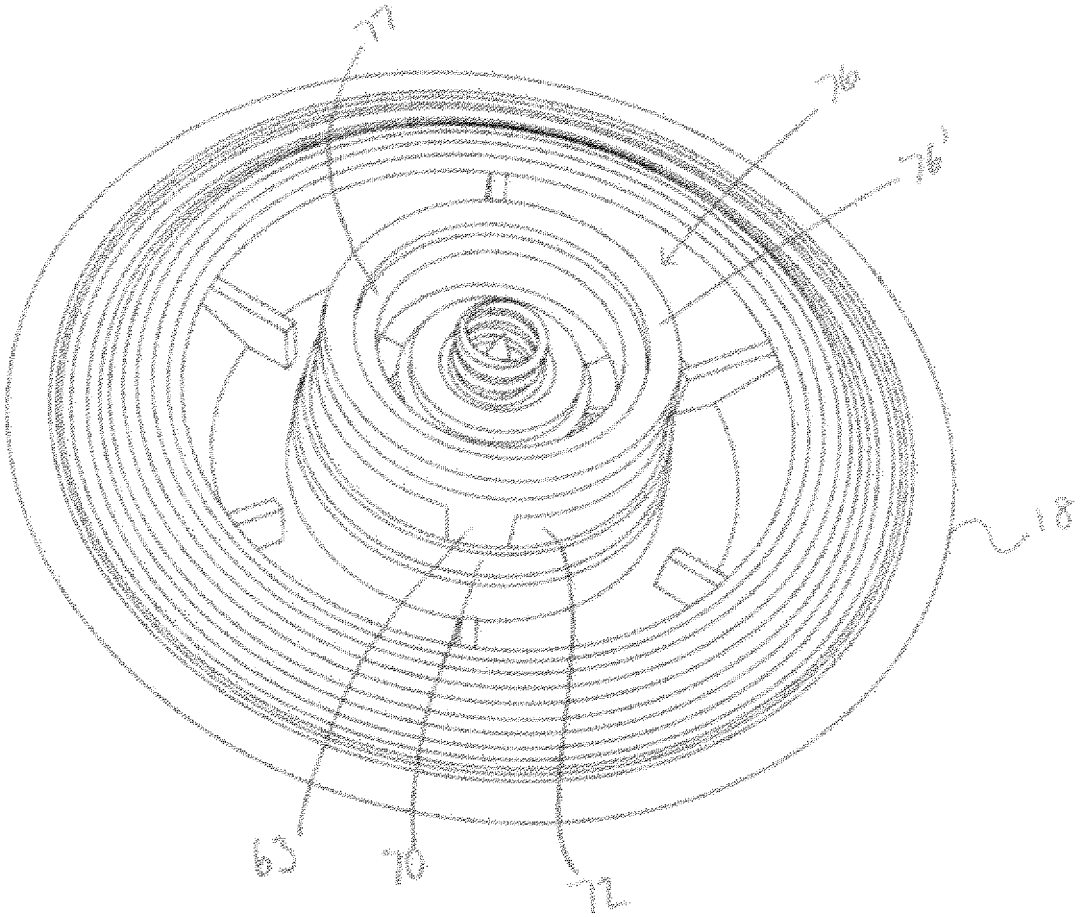
FIG. 4E is a partial perspective view of the embodiment shown in FIG. 4E, with the contact collar illustrated.

FIGS. 4A though 4E illustrate the assembly or positioning of the locking assembly 36 and release assembly 50 within or onto cap 18 of base 12. Specifically, as shown in FIGS. 4A and 4B, retention casing 42 and locking members 41 disposed therein are normally biased into the locking orientation via biasing member 43. As shown in the embodiment illustrated in FIG. 4C, a support member 70 is disposed in a coaxial alignment with the connector member 22 and the retention casing 42. The support member 70 is structured to support or otherwise engage a portion of the displacement structure 60, as shown in FIG. 4D. FIG. 4E illustrates a contact collar 76 disposed in an engaging relation with the displacement member 60, Moreover, as just described, the release assembly 50 of at least one embodiment, comprises a displacement structure 60 or spring-like member. In particular, the displacement structure 60 of at least one embodiment comprises first and second members 61,62 connected to one another via at least one, but preferably, a plurality of biasing connectors 63. In at least one embodiment, the displacement structure 60, and in particular, first and second members 61,61 and biasing connector(s) 63, comprise an integrated single component constructed of the same material or mold. However, it is contemplated that the various components or members 61,62,63 of the displacement structure 60 are separate, but connected components. In any event, as will become apparent from the discussion herein, the biasing connector(s) 63 of at least one embodiment comprises an at least partially flexible and arcuate or "U" shaped configuration and can be made of virtually any material, including, but not limited to a partially flexible or resilient plastic composition or otherwise structured to facilitate the practice of the present invention in the intended manner.

Figure 5:
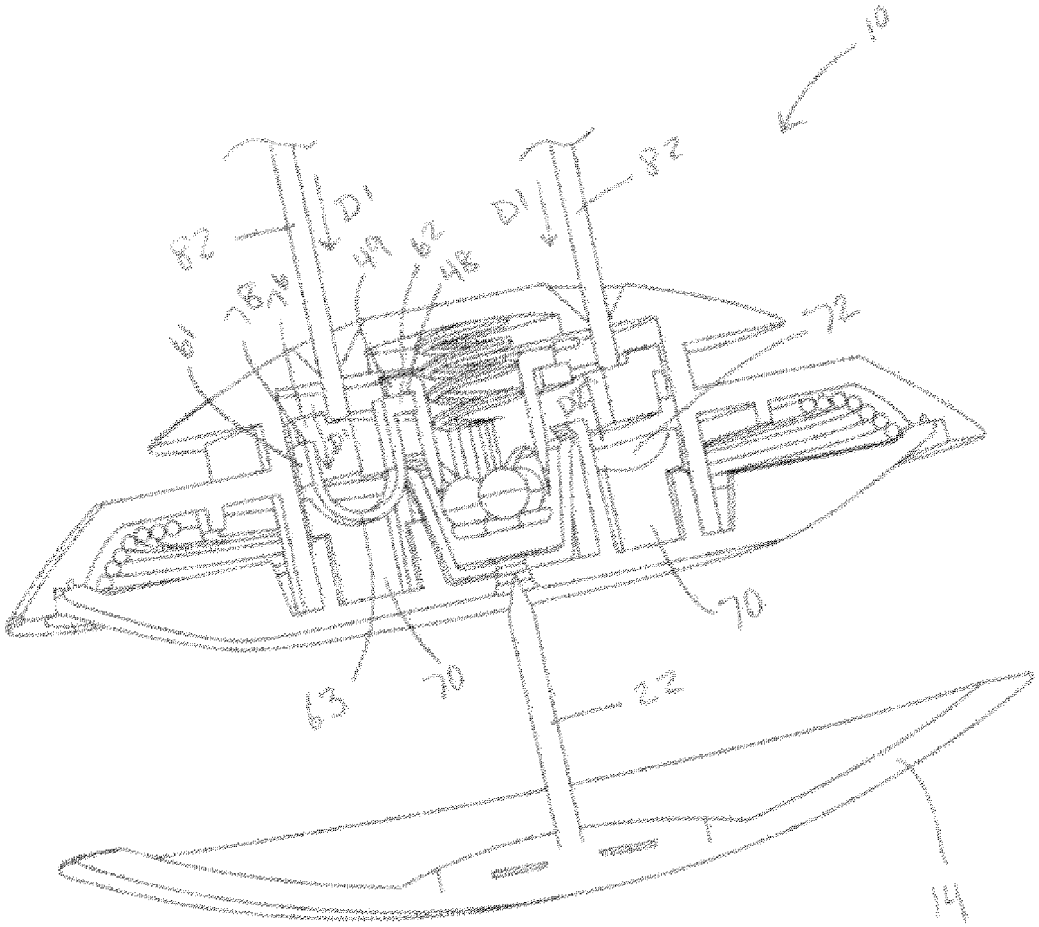
FIG. 5 is a partial cut-away view of at least one embodiment of the present invention.
Figure 6:
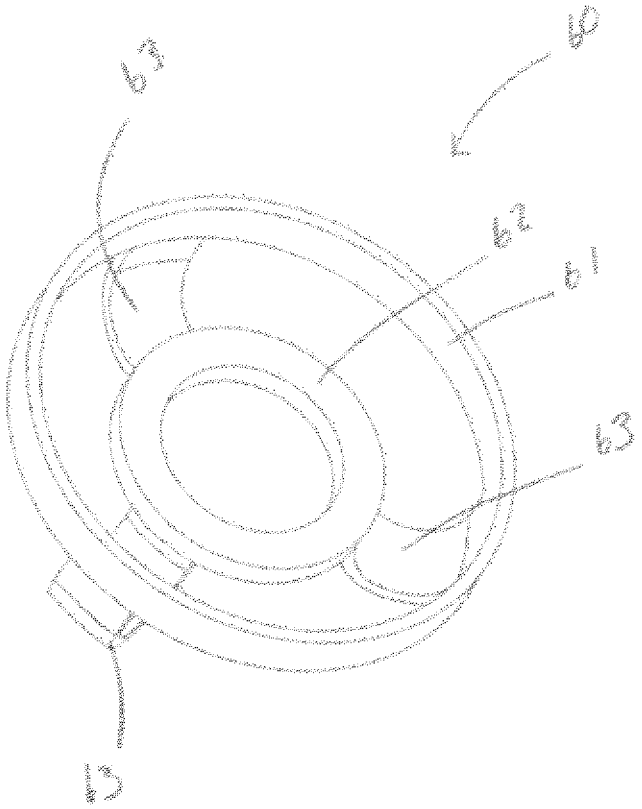
FIG. 6 is a perspective view of the displacement structure as disclosed in accordance with at least one embodiment of the present invention.

Furthermore, the first and second members 61,62 of the displacement structure 60 are disposed in a movable relation to one another via the biasing connector(s) 63. For instance, as illustrated in FIG. 6, first and second members 61,62 may comprise collars or rings that are disposed in a generally coaxial alignment with one another and connected via the biasing connectors 63. As generally illustrated in FIG. 5, as the first member 61 is pushed in a first direction D1, the biasing connectors 63 cause the second member 62 to move in a second, and substantially opposite direction D2. Particularly, the movement of the first and second members 61,62 is utilized to facilitate the authorized release of the tag or attachment member 14 from the base 12, and disposition of the locking assembly 36 out of the locking position. In particular, the second member 62 of the displacement structure 60 comprises a lip or edge 48 disposed under or in an engaging relation with lip or edge 49 of the retention casing. Movement of the lip 48 in direction D2 causes the retention casing 42 and/or the locking assembly 36 to be disposed in a released position. Such authorized release can be accomplished by utilization of an authorized, externally applied detachment assembly, generally referenced as 80. As described in greater detail herein, the detachment assembly 80 includes at least one, but preferably a plurality of at least two detachment members 82.

Figure 7:
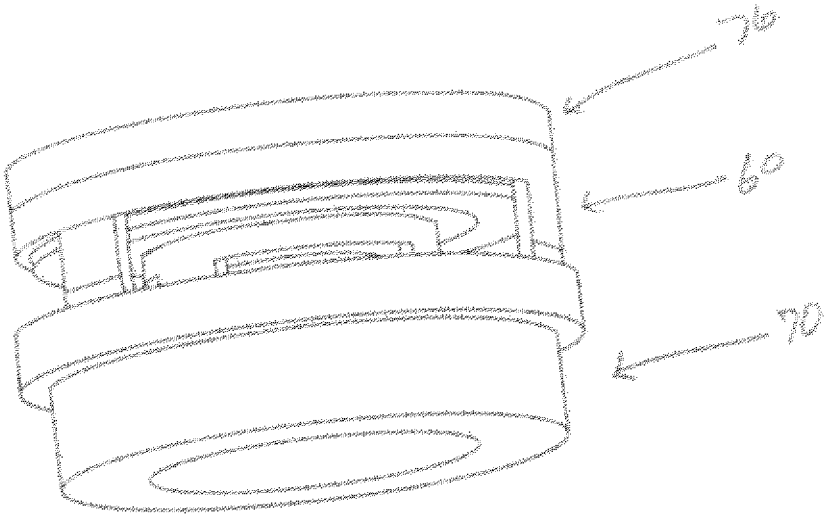
FIG. 7 is a side view of the assembled release assembly of at least one embodiment disclosed herein.

Furthermore, referring now to FIGS. 6 and 7, the release assembly 50 of at least one embodiment of the present invention comprises a support member 70 and contact collar 76. In particular, biasing connectors 63 of the embodiment shown are structured to be disposed in a supporting relation with the support member 70. As the biasing connectors 63 of one embodiment comprise an arcuate or "U" shaped configuration, as shown, the support member 70 of such an embodiment comprises a corresponding arcuate, "U" shaped or concave seat surface 72. As such, the biasing connectors 63 may therefore slide or otherwise move within the concave seat surface 72 in a direction from the first member 61 toward the second member 62. This movement causes the second member 62 to move in a displacement direction D2, as will be described again below.

Still referring to FIG. 6, contact collar 76 is disposed in an engaging relation with the opposite side of the displacement structure 60 so as to "sandwich" the displacement structure 60 between the contact collar 76 and the support member 70. In one embodiment, the contact collar comprises an annular ledge 78 (shown in FIG. 5) disposed in an engaging relation with the first member 61 of the displacement structure 60. Furthermore, as best illustrated in FIG. 4E, contact collar 76 also comprises a receiving ledge 77. As illustrated, the receiving ledge 77 is disposed on the interior surface of the contact collar 76, although it may be on the upper surface 76' or outer surface instead. In any event, the receiving ledge 77 is disposed in a direct engaging relation with the detachment assembly 80, and in particular, the detachment members 82, as shown in FIG. 5. The force of the detachment member 82 onto the receiving ledge 77 is transferred to the annular ledge 78 and through the displacement structure 60.

Figure 8A:
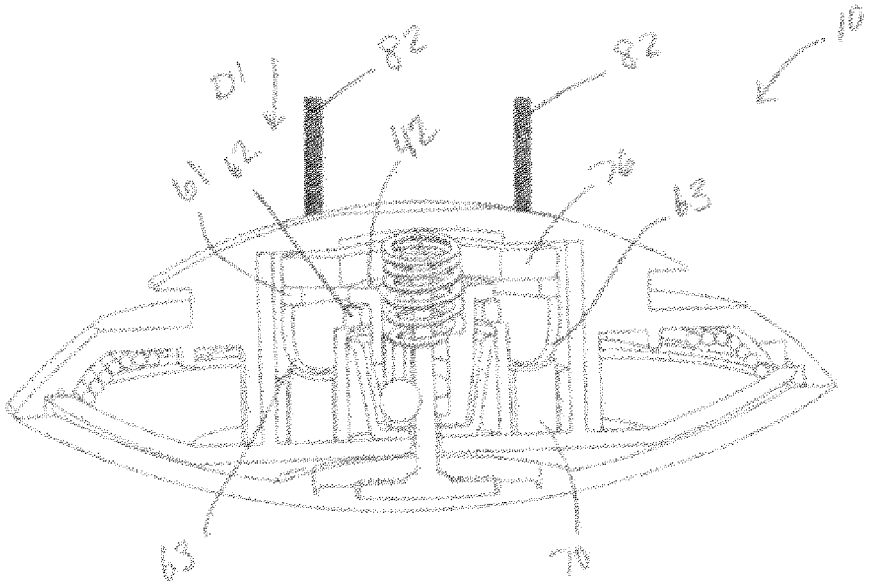
FIGS. 8A and 8B are partial interior cut-away views of the security tag assembly of at least one embodiment of the present invention.
Figure 8B:
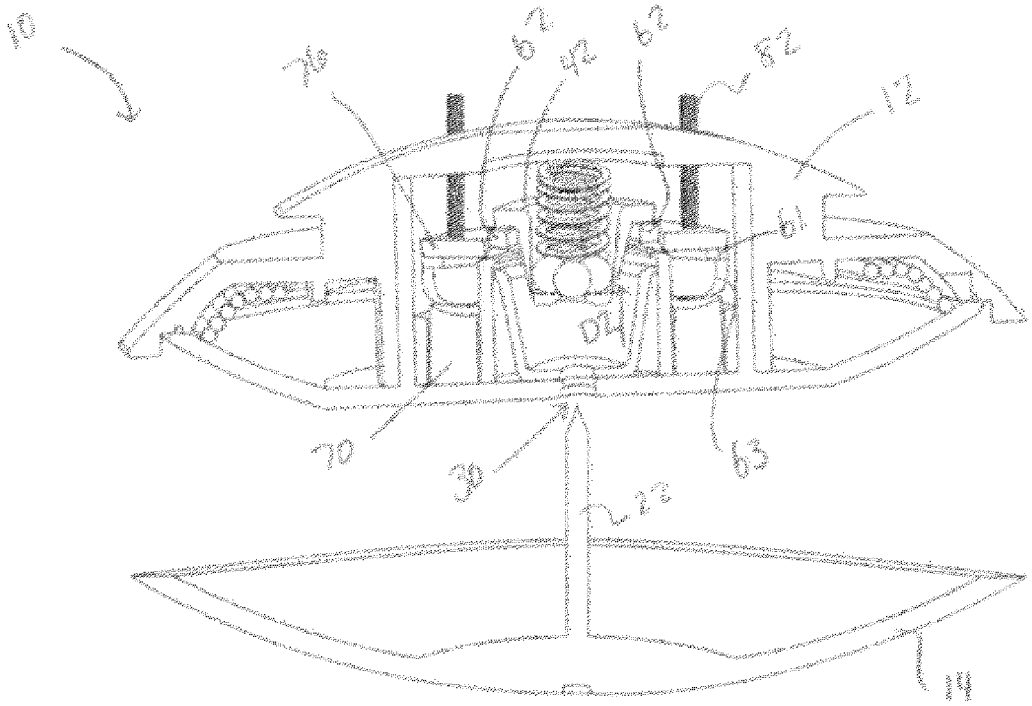
Figure 9:
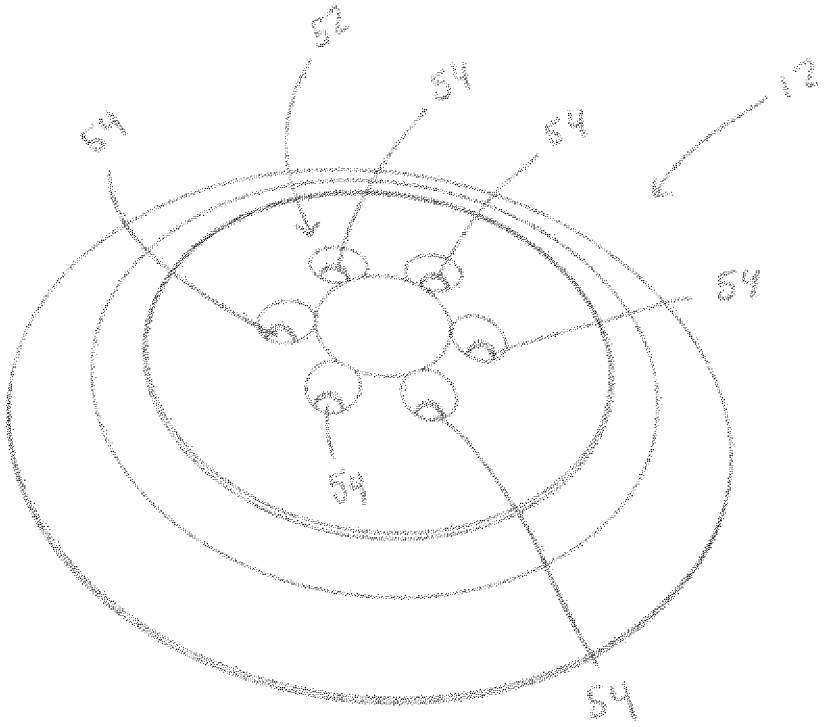
FIG. 9 is an outer perspective view of the base of at least one embodiment of the tag assembly as disclosed herein.

Referring now to FIGS. 8A and 8B, as illustrated, detachment members 82 are structured and disposed to contact or engage the contact collar 76, which will serve to dispose the locking assembly out of the locking position relative to the connector member 22. Specifically, detachment members 82 of detachment assembly 80 will move or project toward the first member 61 or contact collar 76 in an at least partially linear and forced direction of travel D1. First member 61 will compress in direction D1 causing the at least partially flexible biasing connectors 63 to move within the concave support surface of the support member 70. This movement or flexibility of the biasing connectors 63 will serve to dispose the second member 62 of the displacement structure 60 in a second and substantially opposite direction D2. Accordingly, the configuration and interconnection of the displacement structure 60, and in particular the first member 61, second member 62 and biasing connector 63 thereof, is structured to dispose the second member 62 in a direction D2 different and substantially opposite than direction D1, and into a displacing engagement with at least a portion of the locking assembly 36. Specifically, in at least one embodiment, direction D2, which indicates or represents the direction of travel of second member 62, is directed in a substantially opposite direction than direction D1, which indicates or represents the direction of travel of the detachment member(s) 82. In particular, the displacing engagement of the second member 62 is sufficient to dispose the locking assembly 36 out of the locking orientation relative to the connector member 22 such that the attachment or tag member 14 may be easily removed from the base 12, and the tag assembly may be disconnected or disengaged from the merchandise 18. Specifically, the displacing engagement of at least one embodiment is structured to dispose the locking assembly 36 and retention casing 42 against the force of the biasing member 43 so as to dislodge the frictional or forceful engagement of the locking member(s) 41 with the connector member 22.

The entire series of movements disposing the locking assembly 36 from the locked orientation to the unlocked or released orientation is accomplished by movement of the detachment member(s) 82 in a single direction D1. The single direction D1 of at least one embodiment is in an opposing direction D2 of the movement enjoyed by the second member 62 which disengages the locking assembly 36 from its locked orientation relative to the connector member 22. This allows for a simple and quick disconnection of the attachment member 14 from the base 12 with an authorized detachment assembly 80.

In order to further facilitate the authorized release of the tag member 14 from the base 12, due to the interaction of the attachment assembly 80 with the release assembly 50, the base 12 of at least one embodiment further includes an access assembly 52 comprising a plurality of access openings 54. Each of the plurality of access openings 54 is disposed in communicating relation with the interior portion of the base 12. In addition, at least some of the access openings 54 are disposed in an at least partially aligned relation with the contact collar 76 and/or receiving ledge 77 thereof. As a result, the passage of the detachment member 82 through access openings 54 will result in at least a portion (e.g., the end tip) of the detachment member 82 coming into interacting, confronting, engagement or contact with the contact collar 76. As described above, such contact results in movement or disposition of the first member 61 in a first direction D1, thereby causing biasing connectors 63 to flex or bias the second member 62 an outward direction D2 (e.g., toward the detachment member 82), releasing the locking assembly 36 from the locking orientation relative to the connector member 22.

Additional structural features of the tag assembly 10 of the present invention include an alignment assembly, generally referenced at 55. The alignment assembly extends at least partially or completely about the indicated exterior, accessible portion of the base 12. Moreover, the alignment assembly 55 is disposed, dimensioned and configured to be correctly oriented in a detachment assembly 80. More specifically, the alignment assembly 55 includes an exterior surface 56 having a predetermined configuration and/or dimension to be received within a receiving assembly 84 associated with the detachment assembly 80.

In operation, the upper portion or upper end cap 16 of the base 12 passed along or into a trough or like receiving area 85. When so disposed, the predetermined exterior surface 56 of the alignment assembly 55 will be forced into a "correct" or predetermined alignment with the receiving ledge, lip or flange 84. The predetermined surface configuration 56 cooperates with the dimension or configuration of the lip or flange 84 so as to properly align the access assembly 52, and in particular, the access opening(s) 54, with the plurality of detachment members (not illustrated in FIG. 10). For example, the exterior surface of the alignment assembly 55 may include any of a variety of multi-sided configurations which, when disposed within and engaging the lip or flange 84 will serve to automatically align at least some of the plurality of access openings 54 with the detachment members 82, To further facilitate the alignment of at least some of the plurality of access openings 54 with the detachment members 82, the detachment assembly 80 may comprise one or more locking devices 87, for example, disposed within receiving area or channel 85. In particular, the locking device 87 may act as a push-button or automatically retractable flange which is structured to automatically retract upon contact with the tag assembly 10 as the tag assembly 10 slides or moves through channel 85 toward ledge 84. Once the tag assembly 10 clears or otherwise passes the locking device 87 such that one or more access openings 54 are aligned with the detachment members 82, the locking device 87 will be disengaged by the tag assembly 10 and be disposed in an outward, blocking orientation relative to the tag assembly 10. Accordingly, the tag assembly 10 will be locked within the detachment assembly 80 and at least one, but more practically two access openings 84 are aligned with the detachment members 82. Thus, upon actuation of the detachment assembly 80 such that the detachment members penetrate the access openings 54, as described above, the base 12 and attachment member 14 may be easily removed from one another.

Figure 10:
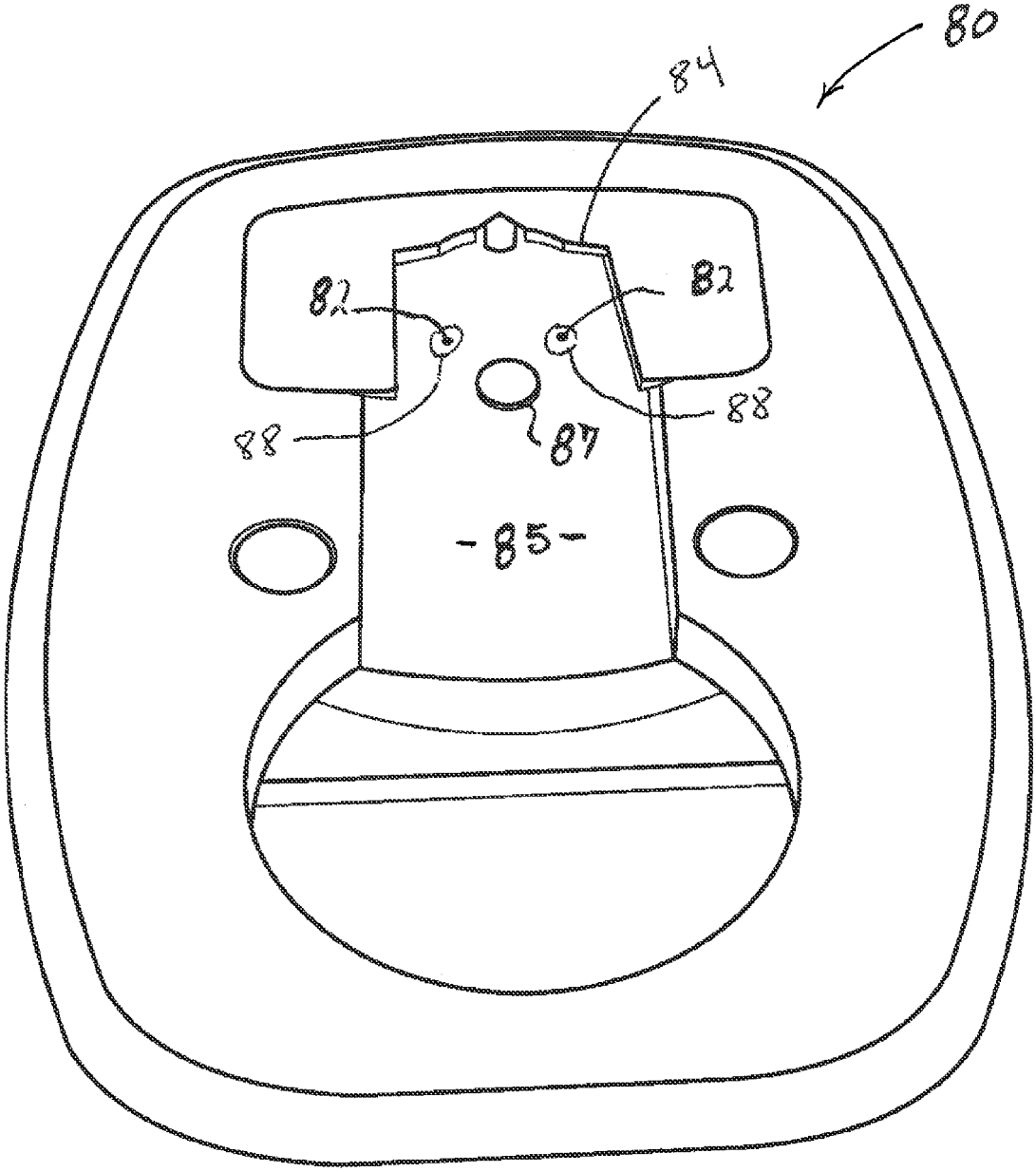
FIG. 10 is a perspective view of at least a portion of a detachment assembly absent representation of the detachment members.

Further with regard to FIG. 10, the detachment members 82 may pass through the apertures 88 in the receiving area 85 and into and through the aligned access openings 54 as described herein. The detachment assembly 80, as represented in FIG. 10, may assume any of a plurality of different structures and configuration structured to facilitate the practice of the present invention in the intended manner.

The various embodiments of the present invention may further include an alarm activating assembly, generally referenced as 95, and may include, for example, the provision of a coil or other structure which includes alarm activating capabilities and/or radio frequency signaling capabilities. As such, the alarm activating assembly is preferably disposed within the interior of the base 12 and in a non-accessible location. Other similar devices may be utilized, including devices comprising data storage capabilities (e.g. to provide inventory, purchase, location, origin of supplier or manufacturer, or other merchandise data) and/or ink releasing capabilities structured to stain or otherwise mark a garment or merchandise to which the security tag assembly 10 is attached.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security tag assembly structured to restrict unauthorized removal of a product from an area, said security tag assembly comprising:

a base including a locking assembly, said locking assembly structured to be biased into a locking orientation, a tag member including an elongated connector member structured to pass through the product and into a locking position, said locking position comprising said connector member passing into said base and into a removable locking engagement with said locking assembly when in said locking position, a release assembly disposed within said base, said release assembly comprising a displacement structure, said displacement structure comprising first and second members connected to one another via at least one biasing connector, said first and second members being disposed in a coaxially movable relation with one another via said at least one biasing connector, said first member of said release assembly being structured for movable disposition in a first direction via an externally applied detachment assembly, said second member being disposable in a second, opposite direction via said at least one biasing connector and into a displacing engagement with at least a portion of said locking assembly upon movable engagement of said first member in said first direction, and said displacing engagement being sufficient to dispose said locking assembly out of said locking orientation relative to said connector member.

2. The security tag assembly as recited in claim 1 wherein said locking assembly comprises a biasing member structured to normally dispose at least one locking member in a confronting, locking engagement with said connector member.

3. The security tag assembly as recited in claim 2 wherein said at least one biasing connector is structured to dispose said second member of said release assembly against the biasing force of said biasing member.

4. The security tag assembly as recited in claim 1 wherein said first and second members of said release assembly comprise coaxially disposed collars.

5. The security tag assembly as recited in claim 4 wherein said coaxially disposed collars are connected to one another via a plurality of spaced apart biasing connectors.

6. The security tag assembly as recited in claim 5 wherein each of said plurality of biasing connectors comprise an arcuate configuration extending between said coaxially disposed collars.

7. The security tag assembly as recited in claim 6 wherein said release assembly further comprises a support member comprising a concave seat surface disposed in a supporting relation with said biasing connectors.

8. The security tag assembly as recited in claim 7 wherein said concave seat surface of said support member and said arcuate configuration of said plurality of biasing connectors comprise corresponding configurations.

9. The security tag assembly as recited in claim 7 wherein said biasing connectors are disposed in a slidable relation within said concave seat surface of said support member upon disposition of said first member in said first direction.

10. The security tag assembly as recited in claim 7 wherein said release assembly further comprises a contact collar disposed in an engaging relation with said first member.

11. The security tag assembly as recited in claim 10 wherein said contact collar comprises a receiving ledge disposable in a direct engaging relation with an externally applied detachment assembly.

12. The security tag assembly as recited in claim 11 wherein said contact collar comprises an annular ledge disposed in an engaging relation with said first member.

13. The security tag assembly as recited in claim 12 wherein said base comprises a plurality of access openings disposed and dimensioned to facilitate passage of a plurality of detachment members therethrough into said engaging relation with said receiving ledge of said contact collar.

14. A security tag assembly structured to restrict unauthorized removal of a product from an area, said security tag assembly comprising:

a base including a locking assembly, said locking assembly structured to be biased into a locking orientation, a tag member including an elongated connector member structured to pass through the product and into a locking position, said locking position comprising said connector member passing into said base and into a removable locking engagement with said locking assembly when in said locking position, a release assembly disposed within said base, said release assembly comprising first and second collars disposed in a coaxial relation to one another and connected to one another via an at least partially flexible biasing connector, said first and second coaxially disposed collars being disposed in a movable relation with one another in substantially opposite directions via said biasing connector, said first collar of said release assembly being structured for movable disposition in a first direction upon an engaging force applied by an external detachment assembly, said second collar of said release assembly being disposable in a second, opposite direction via said biasing connector and into a displacing engagement with at least a portion of said locking assembly upon movable engagement of said first collar in said first direction, and said displacing engagement being sufficient to dispose said locking assembly out of said locking orientation relative to said connector member.

15. The security tag assembly as recited in claim 14 wherein said release assembly further comprises a contact collar, said contact collar comprising a receiving ledge disposable in an engaging relation with the external detachment assembly and a support ledge disposed in an engaging relation with said first collar.

16. The security tag assembly as recited in claim 14 wherein said biasing connector comprises an arcuate configuration.

17. The security tag assembly as recited in claim 16 wherein said release assembly further comprises a support member, said support member comprising a concave seat surface disposed in a supporting relation with said arcuate configuration of said biasing connector.

18. The security tag assembly as recited in claim 17 wherein said biasing connector is disposed in an at least partially movable relation within said concave seat surface.

19. The security tag assembly as recited in claim 18 further comprising a plurality of spaced apart biasing connectors.

20. A security tag assembly structured to restrict unauthorized removal of a product from an area, said security tag assembly comprising:

a base including a locking assembly, said locking assembly structured to be biased into a locking orientation, a tag member including an elongated connector member structured to pass through the product and into a locking position, said locking position comprising said connector member passing into said base and into a removable locking engagement with said locking assembly when in said locking position, a release assembly disposed within said base said release assembly comprising a displacement structure, said displacement structure comprising first and second coaxially disposed collars connected to one another via a plurality of at least partially flexible biasing connectors, said plurality of biasing connectors comprising an arcuate configuration, a contact collar comprising a receiving ledge disposable in an engaging relation with an external detachment assembly and a support ledge disposed in an engaging relation with said first collar of said displacement structure, a support member comprising a concave seat surface disposed in a supporting relation with said arcuate configuration of each of said plurality of biasing connectors, wherein said displacement structure is disposed between said contact collar and said support member, said first and second collars of said displacement structure being disposed in a movable relation with one another in substantially opposite directions via said plurality of biasing connectors, said first collar being structured for movable disposition in a first direction upon an engaging force applied by the external detachment assembly, said second collar being disposable in a second, substantially opposite direction via said biasing connectors and into a displacing engagement with at least a portion of said locking assembly upon movable engagement of said first collar in said first direction, and said displacing engagement being sufficient to dispose said locking assembly out of a locking orientation relative to said connector member.

* * * * *

UNITED STATES PATENT AND TRADEMARK OFFICE

CERTIFICATE OF CORRECTION

PATENT NO. : 8,590,349 B2
APPLICATION NO. : 13/425055
DATED : November 26, 2013
INVENTOR(S) : Johan Skjellerup and Eddie L. Stenild It is certified that error appears in the above-identified patent and that said Letters Patent is hereby corrected as shown below:

Title page, item [75] the spelling of the Second Joint Inventor's last name is hereby corrected from "Stenilo" to "Stenild."

Signed and Sealed this
Twentieth Day of May, 2014

Michelle K. Lee

Michelle K. Lee
*Deputy Director of the United States Patent and Trademark Office*